US010237659B2

(12) United States Patent
Wang et al.

(10) Patent No.: US 10,237,659 B2
(45) Date of Patent: Mar. 19, 2019

(54) LOUDSPEAKER MODULE

(71) Applicant: Goertek Inc., Shandong (CN)

(72) Inventors: Yu Wang, Shandong (CN); Qianqian Song, Shandong (CN); Jianbin Yang, Shandong (CN); Zhi Li, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 15/758,421

(22) PCT Filed: May 6, 2016

(86) PCT No.: PCT/CN2016/081246

§ 371 (c)(1),
(2) Date: Mar. 8, 2018

(87) PCT Pub. No.: WO2017/113558

PCT Pub. Date: Jul. 6, 2017

(65) Prior Publication Data

US 2018/0249254 A1 Aug. 30, 2018

(30) Foreign Application Priority Data

Dec. 31, 2015 (CN) ..... 2015 1 1030198

(51) Int. Cl.
*H04R 1/04* (2006.01)
*H04R 9/02* (2006.01)

(52) U.S. Cl.
CPC ..... *H04R 9/02* (2013.01); *H04R 1/04* (2013.01)

(58) Field of Classification Search
CPC .... H04R 1/025; H04R 2499/13; H04R 9/066; H04R 1/24; H04R 2440/05; H04R 7/045;
(Continued)

(56) References Cited

U.S. PATENT DOCUMENTS

2014/0079265 A1 3/2014 Ouyang
2015/0063607 A1 3/2015 Li et al.
2016/0198248 A1* 7/2016 Wang ..... H04R 1/02 381/394

FOREIGN PATENT DOCUMENTS

CN 102625216 A 8/2012
CN 102638737 A * 8/2012
(Continued)

OTHER PUBLICATIONS

International Searching Authority, International Search Report (ISR) and Written Opinion for International Application No. PCT/CN2016/081246, dated Sep. 27, 2016, 11 pages, State Intellectual Property Office of the P.R.C., China.

*Primary Examiner* — Curtis A Kuntz
*Assistant Examiner* — Julie X Dang
(74) *Attorney, Agent, or Firm* — Alston & Bird LLP

(57) ABSTRACT

A loudspeaker module, relating to the technical field of electroacoustic products. The loudspeaker module comprises a housing. A loudspeaker unit is accommodated in the housing. An electrical connection member which is a metal sheet is fixed on the housing. An inner bonding pad is disposed at one end of the electrical connection member, and an outer bonding pad is disposed at the other end of the electrical connection member. The inner bonding pad is located in the housing and is electrically connected to the loudspeaker unit. The outer bonding pad is exposed outside the housing and is electrically connected to a terminal circuit. The loudspeaker module of the present invention solves the technical problems in the prior art such as poor tone quality, low reliability, and a complicated assembling process of a loudspeaker module. The loudspeaker module of the present invention has good tone quality, high reliability, a long service life, a simple assembling process, and high production efficiency, and occupies a small space of a
(Continued)

terminal, thereby facilitating the development of the terminal towards smaller size.

7 Claims, 2 Drawing Sheets

(58) Field of Classification Search
CPC .... H04R 9/045; H04R 1/021; H04R 2400/07; H04R 2499/11; H04R 2499/15
USPC ..... 381/332, 396, 403, 151, 162, 182, 186, 381/302, 389, 394, 395
See application file for complete search history.

(56) References Cited

FOREIGN PATENT DOCUMENTS

| | | | |
|---|---|---|---|
| CN | 102638737 | A | 8/2012 |
| CN | 202535531 | U | 11/2012 |
| CN | 202535532 | U | 11/2012 |
| CN | 202679603 | U | 1/2013 |
| CN | 105407438 | A | 3/2016 |
| CN | 205249462 | U | 5/2016 |

* cited by examiner

LOUDSPEAKER MODULE

CROSS-REFERENCE TO RELATED APPLICATIONS

This application is a National Stage of International Application No. PCT/CN2016/081246, filed on May 6, 2016, which claims priority to Chinese Patent Application No. 201511030198.9, filed on Dec. 31, 2015, both of which are hereby incorporated by reference in their entireties.

BACKGROUND

Technical Field

The present invention relates to the field of electroacoustic products, and in particular, to a loudspeaker module.

Description of Related Art

As an important acoustic component in a portable electronic terminal, a loudspeaker module is an energy conversion apparatus for realizing conversion between an electrical signal and a sound signal. The loudspeaker module generally comprises a housing formed by integrating at least two housing bodies, wherein a loudspeaker unit is accommodated in the housing and divides the cavity of the module into a front acoustic cavity and a closed rear acoustic cavity; and meanwhile, the loudspeaker unit located in the cavity of the module needs to be electrically connected to a terminal circuit outside the module to receive an audio electrical signal. At present, generally, the loudspeaker unit in the loudspeaker module is electrically connected to the terminal circuit via a wire harness and a connector; a U-shaped groove is formed in the housing corresponding to an outlet position of the wire harness; the wire harness is stuck in the U-shaped groove and passes through the rear acoustic cavity of the module; and an adhesive is spread at the U-shaped groove to seal the rear acoustic cavity of the module after the housing bodies are integrated together by ultrasonic waves. The loudspeaker module adopting this structure has the following defects.

First, the wire harness located in the cavity of the module will shake and generate noise when the loudspeaker unit works, resulting in decreased sound quality of the loudspeaker module.

Second, it is required to spread the adhesive at the U-shaped groove to seal the rear acoustic cavity after the housing bodies are integrated together by ultrasonic waves. However, the adhesive will be gradually aging as the working time of the module increases. As a result, the risk of air leakage of the rear acoustic cavity is increased, which reduces the reliability and shortens the service life of the loudspeaker module.

Third, when assembling the loudspeaker module, it is required to organize the wire harness and spread the adhesive for sealing, resulting in tedious procedures and relatively low production efficiency.

Fourth, a part of the wire harness passing through the cavity of the module needs a connector to be electrically connected to the terminal circuit, so that it is required to reserve a space for the wire harness and the connector in the terminal. As a result, the design difficulty of the terminal is increased; and meanwhile, the trend of miniaturization of the terminal is hampered.

BRIEF SUMMARY

For the above defects, the technical problem to be solved by the present invention is to provide a loudspeaker module high in sound quality and production efficiency, simple in assembling procedures, small in occupied terminal space, and favorable for miniaturization of a terminal.

In order to solve the above technical problem, the present invention provides the following technical solutions.

A loudspeaker module comprises a housing in which a loudspeaker unit is accommodated, wherein an electrical connector is fixed onto the housing and is a metal sheet; an inner pad is arranged at one end of the electrical connector, and an outer pad at the other end thereof; the inner pad is located in the housing and electrically connected to the loudspeaker unit; and the outer pad is exposed outside the housing and electrically connected to a terminal circuit.

The housing comprises a first housing body and a second housing body which are integrated together; the electrical connector is fixed onto the second housing body; a through hole is formed in the first housing body at a position corresponding to the outer pad; and the outer pad is located at the through hole, and exposed outside the first housing body.

A base for electrical connection is arranged at the inner side of the second housing body, and adopts a three-stepped structure; the electrical connector is fixed onto the base for electrical connection; the inner pad is located on a bottom layer end surface of the base for electrical connection, and the outer pad on a top layer end surface thereof; and the top layer is located in the through hole.

A middle layer of the base for electrical connection forms a boss at the periphery of the top layer; and the height of the top layer is equal to the thickness of the first housing body where the through hole is formed.

The inner pad and the loudspeaker unit are electrically connected via a wire; a slot for fixing wire is formed at the side of the bottom layer close to the loudspeaker unit; and the wire passes through the slot for fixing wire to be welded on the inner pad.

Two limited posts are arranged at the edge of the bottom layer; and a space between the two limited posts forms the slot for fixing wire.

The inner pad and the outer pad are connected integrally via a connection part, and are parallel to each other; and the connection part is perpendicular to the inner and to the outer pads which are located at two sides of the connection part, respectively.

There are two electrical connectors which are the same in structure and opposite to each other; the top layer of the base is located at the middle of the bottom layer of the base; and the two inner pads are located on the bottom layer end surfaces at two sides of the top layer, respectively.

A third housing body is integrated to the second housing body at a position corresponding to the loudspeaker unit; a sound hole is formed between the second housing body and the third housing body which are located at the edge of the loudspeaker module, and is covered with a dustproof mesh.

By adopting the above technical solutions, the present invention has the following beneficial effects.

The loudspeaker module provided by the present invention comprises the housing in which the loudspeaker unit is accommodated; the electrical connector configured to electrically connect the loudspeaker unit and the terminal circuit is a metal sheet; the inner pad is arranged at one end of the metal sheet, is located in the housing, and is electrically connected to the loudspeaker unit; and the outer pad is arranged at the other end of the metal sheet, is exposed outside the housing, and is electrically connected to the terminal circuit. Compared with the prior art, the present invention adopting the metal sheet to replace the existing wire harness and the connector has the following advantages.

First, the metal sheet is fixed onto the housing and thus will not shake in the cavity of the module. Therefore, there is no noise, and the sound quality of the loudspeaker module is improved.

Second, a procedure of organizing the wire harness is eliminated, so that the assembling procedures are simplified and the production efficiency is improved.

Third, the outer pad is directly electrically connected to the terminal circuit without a connector, so that the internal space of the terminal is saved, and the design difficulty of the terminal is reduced. Therefore, the layout of the terminal is more compact and the miniaturization of the terminal is facilitated.

The middle layer of the base for electrical connection forms the boss at the periphery of the top layer. The height of the top layer is equal to the thickness of the first housing body where the through hole is formed. The boss plays a limitation function in the assembling of the module, increases a contact area between the first housing body and the second housing body, and blocks a gap between the side wall of the through hole and the side of the top layer, so that good sealing between the first housing body and the second housing body can be ensured without using the adhesive. Further, the adhesive spreading procedure is eliminated, thereby simplifying the assembling procedures of the module, avoiding the risk of air leakage due to adhesive aging, improving the reliability of the loudspeaker module, and prolonging the service life of the loudspeaker module.

The inner pad and the loudspeaker unit are electrically connected via a wire; the slot for fixing wire is formed at the side of the bottom layer close to the loudspeaker unit; and the wire passes through the slot for fixing wire to be welded on the inner pad. The slot for fixing wire plays a fixing function on the wire, so that the wire is prevented from shaking to avoid noise generation when the loudspeaker unit works. Meanwhile, a pulling force generated by the shaking of the wire at the welding portion of the wire and the inner pad is avoided to effectively prevent the wire from breaking at the welding portion. Thus, the reliability of the electrical connection between the wire and the inner pad is improved, and the reliability of the loudspeaker module is improved.

To sum up, the loudspeaker module provided by the present invention solves the technical problems of poor sound quality, low reliability and complicated assembling procedures of the loudspeaker module in the prior art, and is high in sound quality, reliability and production efficiency, long in service life, simple in assembling procedures, small in occupied terminal space, and favorable for the miniaturization of the terminal.

REFERENCE NUMERALS IN THE FIGURES

10: first housing body;
12: through hole;
20: second housing body;
22: base for electrical connection;
220: bottom layer;
222: middle layer;
224: top layer;
226: limited post;
24: positioning step;
30: third housing body;
32: arc surface;
40: loudspeaker unit;
50: electrical connector;
52: outer pad;
54: inner pad;
56: connection part;
60: wire; and
70: dustproof mesh.

DETAILED DESCRIPTION OF THE VARIOUS Embodiments

The present invention will be further described below in combination with the drawings and the embodiments.

In the description, the term "inner side" refers to the side close to the center of the module, and the term "outer side" refers to the side far from the center of the module.

Figure 1:
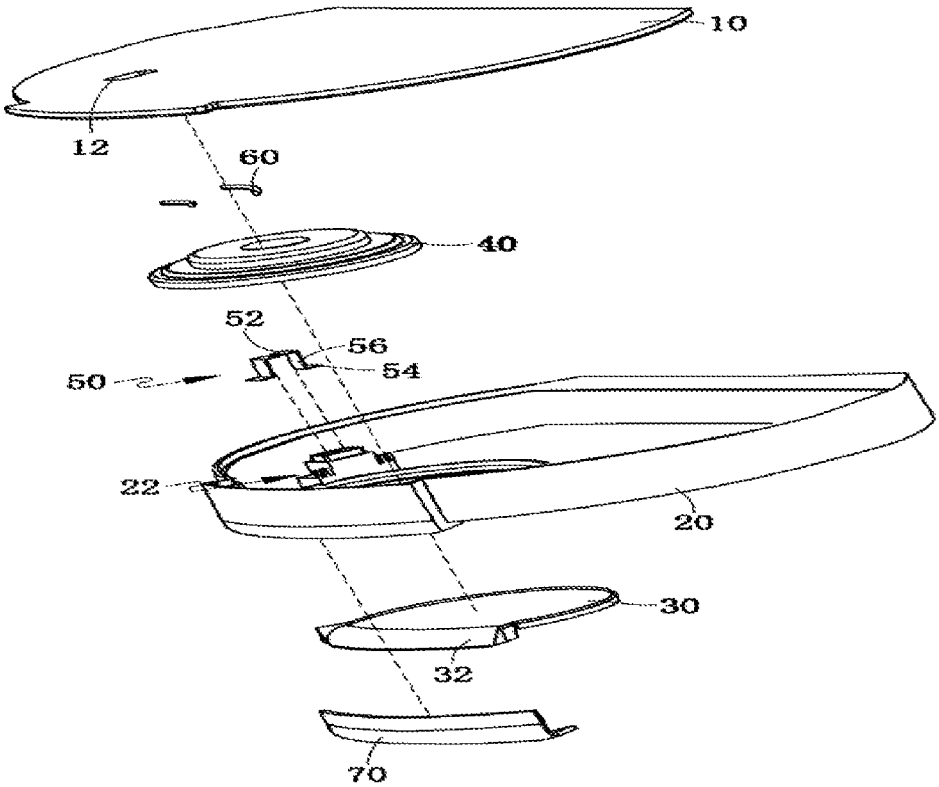
FIG. 1 is a schematically exploded structure view of a loudspeaker module according to an embodiment of the present invention.
Figure 2:
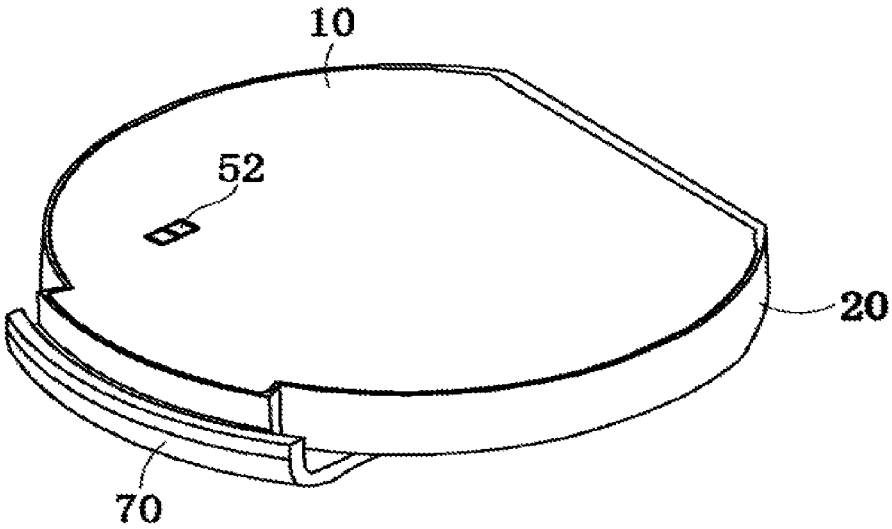
FIG. 2 is an assembled view of FIG. 1.

As shown in FIGS. 1 and 2, a loudspeaker module comprises a housing including a first housing body 10, a second housing body 20 and a third housing body 30 which are integrated together by ultrasonic waves. A loudspeaker unit 40 is accommodated in the space enclosed by the first, second and third housing bodies 10, 20 and 30, and divides the cavity of the module into a front acoustic cavity and a rear acoustic cavity. The rear acoustic cavity is enclosed by the loudspeaker unit 40 and the first and second housing bodies 10 and 20; and the front acoustic cavity is enclosed by the loudspeaker unit 40 and the second and third housing bodies 20 and 30.

Figure 3:
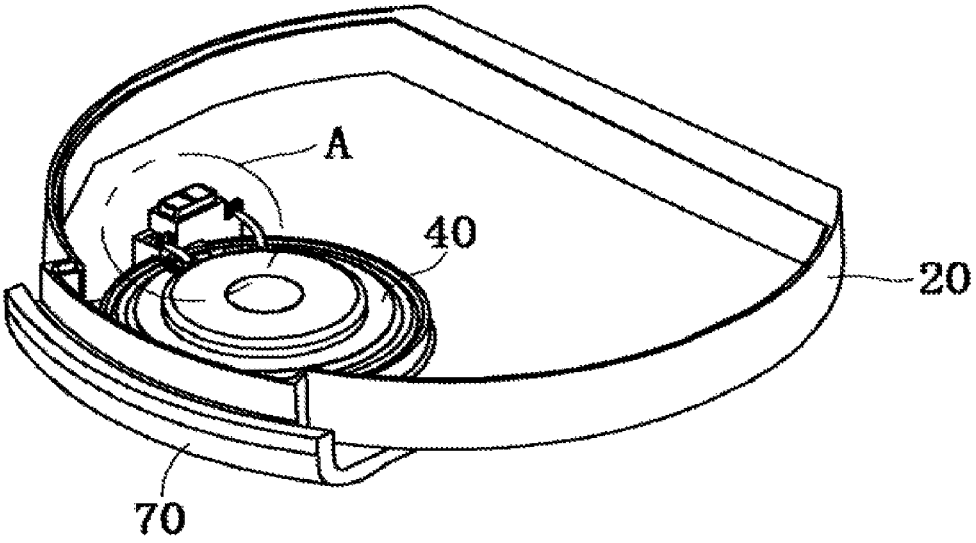
FIG. 3 is a schematically structural view of FIG. 2 without a first housing body.
Figure 4:
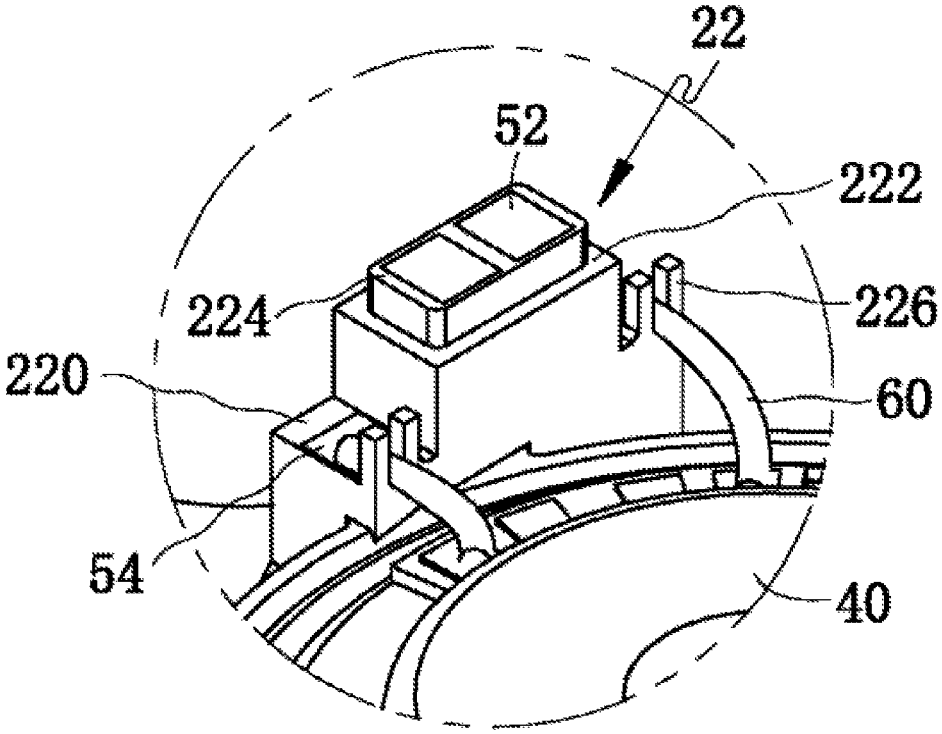
FIG. 4 is an enlarged view of part A in FIG. 3.

As shown in FIGS. 1, 3 and 4, the second housing body 20 is located in the rear acoustic cavity, and is provided with a base for electrical connection 22 close to the loudspeaker unit 40, wherein the base for electrical connection is of a three-stepped structure. A bottom layer 220, a middle layer 222 and a top layer 224 are sequentially arranged in the direction from the second housing body 20 to the first housing body 10. The areas of the bottom layer 220, the middle layer 222 and the top layer 224 decrease sequentially. The width of the middle layer 222 is the same as that of the bottom layer 220. The middle layer 222 is located at the middle of the bottom layer 220. That is, the bottom layer 220 has the end surfaces at two sides of the middle layer 222.

As shown in FIGS. 1 and 4, two electrical connectors 50 for electrically connecting the loudspeaker unit 40 and the terminal circuit are injection-molded on the base for electrical connection 22. The two electrical connectors 50 are metal sheets and have the same structure; and each electrical connector comprises an inner pad 54 and an outer pad 52 parallel to each other and connected integrally via a connection part 56 which is perpendicular to the inner and outer pads 54 and 52. The inner pad 54 and the outer pad 52 are located at the two sides of the corresponding connection part 56, respectively. That is, seen from the side, each electrical connector 50 is approximately zigzag, and the inner pad 54, the connection part 56 and the outer pad 52 are of an integral structure and are formed by bending a strip-shaped metal sheet. The two electrical connectors 50 are opposite to each other. That is, the two inner pads 54 are located on the end surfaces of the bottom layer 220 at the two sides of the middle layer 222 (the top layer 224), respectively; and the two outer pads 52 are located at the end surface of the top layer 224. The connection parts 56 are injection-molded inside the base for electrical connection 22. A through hole 12 matched with the top layer 224 in shape and size is formed in the first housing body 10 at a position corresponding to the top layer 224; and the top layer 224 is located in the through hole 12. The two outer pads 52 are exposed outside the first housing body from the through hole 12, and are electrically connected to the terminal circuit. Both the two inner pads 54 are located in the cavity of the module, and are electrically connected to the positive electrode and the negative electrode of the loudspeaker unit 40 via two short wires 60, respectively.

As shown in FIGS. 1, 2 and 4, the top layer 224 is located at the middle of the middle layer 222. That is, the middle layer 222 forms a boss around the top layer 224, and the height of the top layer 224 is equal to the thickness of the first housing body 10 where the through hole 12 is formed. In this structure, it is ensured that the outer pads 52 are exposed outside of the first housing body 10 without occupying the external space of the module, and meanwhile, the sealing performance of the rear acoustic cavity is improved.

As shown in FIG. 4, two limited posts 226 are sequentially arranged side by side at one side of each end surface of the bottom layer 220 close to the loudspeaker unit 40. That is, the two limited posts 226 are arranged on each of the end surfaces of the bottom layer 220 at the two sides of the middle layer 222. A slot for fixing wire is formed between each pair of the limited posts 226; and the two wires 60 respectively pass through the corresponding slot for fixing wires to be welded onto the inner pads 52.

As shown in FIGS. 1 and 2, a sound hole (not shown in the figures) is formed between the second housing body 20 and the third housing body 30 which are located at the edge of the module, and is covered with the dustproof mesh 70 which is a piece of mesh cloth. One side of the dustproof mesh 70 is adhesively fixed onto the third housing body 30, and the other side thereof onto the side wall of the second housing body 20.

As shown in FIG. 1, an arc surface 32 is arranged at the sound hole in the third housing body 30 and enables air to flow more smoothly, so that the resistance of the sound radiating outwards is reduced, and the acoustic performance of the loudspeaker module is improved.

The loudspeaker module provided by the present invention adopts the metal pieces as the electrical connectors, so that noise is effectively reduced, the sound quality and the production efficiency of the loudspeaker module are improved; meanwhile, the assembling procedures of the loudspeaker module are simplified, the sealing performance thereof is good, the reliability thereof is high, and the service life thereof is long.

The above embodiments only illustrate the technical solutions of the present invention that the metal sheets serve as the electrical connectors. The structure of the loudspeaker module or the electrical connector is not limited to the above structure. The technical solutions of the present invention may be applied to any loudspeaker module. Those skilled in the art can apply the technical solutions of the present invention to loudspeaker modules of other structures without any creative effort according to the description of the above embodiments. Therefore, no matter if the structures of a loudspeaker module and an electrical connector are the same as those described in the above embodiments or not, so long as the metal sheet, instead of a wire harness, serves as the electrical connector so as to improve the sound quality and the sealing performance and simplify the assembling procedures, such products shall fall within the protection scope of the present invention.

The names of the first housing body, the second housing body and the third housing body involved in this description are only for distinguishing technical features and do not represent the position relation and the assembling sequence among the three.

The present invention is not limited to the above specific implementation modes, and various changes made by those skilled in the art without any creative effort based on the above concept shall fall within the protection scope of the present invention.

What is claimed is:

1. A loudspeaker module, comprising: a housing in which a loudspeaker unit is accommodated, wherein: an electrical connector is fixed onto the housing, the electrical connector is a metal sheet, an inner pad is arranged at one end of the electrical connector and an outer pad is arranged at the other end of the electrical connector, the inner pad is located in the housing and electrically connected to the loudspeaker unit, and the outer pad is exposed outside the housing and electrically connected to a terminal circuit, wherein: the housing comprises a first housing body and a second housing body which are integrated together, the electrical connector is fixed onto the second housing body, a through hole is formed in the first housing body at a position corresponding to the outer pad, and the outer pad is located at the through hole and exposed outside the first housing body, and a base for electrical connection is arranged at the inner side of the second housing body and adopts a three-stepped structure, the electrical connector is fixed onto the base for electrical connection, the inner pad is located on a bottom layer end surface of the base for electrical connection, and the outer pad on a top layer end surface of the base for electrical connection; and the top layer is located in the through hole.

2. The loudspeaker module of claim 1, wherein a middle layer of the base for electrical connection forms a boss at the periphery of the top layer; and the height of the top layer is equal to the thickness of the first housing body where the through hole is formed.

3. The loudspeaker module of claim 2, wherein the inner pad and the loudspeaker unit are electrically connected via a wire; a slot for fixing wire is formed at the side of the bottom layer close to the loudspeaker unit; and the wire passes through the slot for fixing wire to be welded on the inner pad.

4. The loudspeaker module of claim 3, wherein two limited posts are arranged at the edge of the bottom layer; and a space between the two limited posts forms the slot for fixing wires.

5. The loudspeaker module of claim 4, wherein the inner pad and the outer pad are connected integrally via a connection part, and are parallel to each other; and the connection part is perpendicular to the inner and to the outer pads which are located at two sides of the connection part, respectively.

6. The loudspeaker module of claim 5, wherein there are two electrical connectors which are the same in structure and opposite to each other; the top layer of the base is located at the middle of the bottom layer of the base; and the two inner pads are located on the bottom layer end surfaces, respectively.

7. The loudspeaker module of claim 1, wherein a third housing body is integrated onto the second housing body at a position corresponding to the loudspeaker unit; and a sound hole is formed between the second housing body and the third housing body which are located at the edge of the loudspeaker module, and is covered with a dustproof mesh.

* * * * *